United States Patent [19]

Kawai et al.

[11] 4,291,644

[45] Sep. 29, 1981

[54] APPARATUS FOR FABRICATING COMPOSITE METAL WIRE

[75] Inventors: Kazumichi Kawai; Yasuo Kaneko; Keizo Abe; Hideo Matsuo; Yoshinori Kishi; Yasuhiko Miyake; Yoshihiro Matsuyama, all of Hitachi, Japan

[73] Assignee: Hitachi Cable Ltd., Tokyo, Japan

[21] Appl. No.: 95,281

[22] Filed: Nov. 19, 1979

Related U.S. Application Data

[63] Continuation of Ser. No. 937,830, Aug. 29, 1978, abandoned.

[30] Foreign Application Priority Data

Aug. 31, 1977 [JP] Japan ..... 52-104447
Sep. 6, 1977 [JP] Japan ..... 52-106922

[51] Int. Cl.[3] ..... B05C 3/02

[52] U.S. Cl. ..... 118/704; 118/32; 118/33; 118/68; 118/69; 118/72; 118/300; 118/405; 118/620

[58] Field of Search ..... 118/33, 405, 407, 428, 118/704, 620, 69, 32, 72, 68, 300

[56] References Cited

U.S. PATENT DOCUMENTS 2,914,419 11/1959 Oganowski ..... 117/7
3,186,861 6/1965 Smith et al. ..... 118/33 X

*Primary Examiner*—Bernard D. Pianalto
*Attorney, Agent, or Firm*—Burns, Doane, Swecker & Mathis

[57] ABSTRACT

A method of fabricating composite metal wires such as aluminium clad steel wires is disclosd which comprises providing a core of hard metal with a cladding of soft metal by extrusion. In fabricating a composite metal wire by extrusion, a core is generally aligned, polished, cleaned or otherwise pretreated before entering an extruder so that a high and variable tension is imparted to the core. By avoiding such tension variation and maintaining the core under a constant low tension and by electrically heating the core before the core enters the extruder, a composite metal wire of improved quality is fabricated in a stable manner.

14 Claims, 2 Drawing Figures

APPARATUS FOR FABRICATING COMPOSITE METAL WIRE

This is a continuation of application Ser. No. 937,830, filed Aug. 29, 1978 now abandoned.

BACKGROUND OF THE INVENTION

This invention relates to a method of fabricating a composite metal wire such as an aluminium clad steel wire by extruding a cladding of soft metal around a core of hard metal.

In prior art extrusion processes for fabricating aluminium clad steel wires, a steel core is generally aligned, polished, cleaned or otherwise pretreated and then preheated by conducting electric current thereinto before it is introduced into an extruder. To introduce the core into an extruder and to take it in the form of a composite wire from the extruder, a haul-off unit is located downstream of the extruder to pull the composite wire. Simply pulling the composite wire is not satisfactory. Such a haul-off unit should pull the composite wire at a constant rate. Unless the composite wire is moved at a constant rate, the cladding will vary in thickness so that some products may be rejected. It may be possible to further stretch such clad products using a die. Uniform stretching is difficult and the resulting products will vary in quality. However, this problem has been eliminated by the state-of-the-art haul-off units which can pull a core or composite wire at a constant rate.

It has been found that although a composite wire having a cladding of a uniform thickness is produced, such claddings are liable to peeling or cracking. Furthermore, wires are sometimes broken during extrusion.

The inventors have cooperatively made a research on the above-mentioned problems and have found that although a clad wire is pulled at a constant rate, the tension imparted to a core entering an extruder varies over an unexpectedly wide range and sometimes increases to an extremely high level. Anticipating that this tension variation predominantly causes the above-mentioned shortcomings, the inventors have accomplished this invention.

According to the findings of the inventors, variation of tension to a core will largely affect the adhesion of aluminium or cladding material to the core during extrusion. That is, the adhesion varies as the tension varies. Particularly, an extremely high accidental tension in addition to the normal tension required for pulling will cause breaking of a core.

It will be apparent that such variation of tension to a core occurs during pretreatments including alignment, polishing and cleaning. The core is contacted with an electrode pulley to conduct electric current for preheating, which also causes such variation of tension. If electric current is directly conducted into the core under an increased tension, the core which is thus preheated is stretched to a large extent and tends to be broken. It is also desirable from this point of view that the tension imparted to a core is constant and low. In conventional techniques a core is subject to a tension as high as about 80–90% of the breaking tension of the core. Furthermore, in the case of preheating by the direct electrical conduction, a core tends to oscillate particularly when tension varies along the core. Oscillation will adversely affect the contact of a core with an electrode pulley and sometimes causes spark, damaging the core.

The primary object of this invention is to provide an improved method of fabricating a composite metal wire by introducing a core into an extruder while it is kept under a constant low tension and preheated by conducting electric current thereinto whereby extrusion is carried out in a stable manner and the quality of products is improved.

According to this invention, there is provided a method of fabricating a composite metal wire comprising the steps of subjecting a core of hard metal to pretreatments including alignment, polishing and cleaning and then to preheating, passing the core through an extruder, and thereby extruding a cladding of soft metal around the core, characterized in that the core is introduced into the extruder while the same is kept under a constant low tension of equal to or less than 50%, preferably 5–20% of its breaking tension and preheated by conducting electric current thereinto.

A preferred mode of keeping a core under a constant low tension is to control the tension imparted to the core by locating forcedly driven core feed and haul-off units upstream and downstream of the extruder, respectively, and locating at least one feed-rate correcting dancer roll between these units. In this case, the core feed and haul-off units are synchronously operated at the same rate. The dancer roll serves to compensate for an error in feed rate between the feed and the haul-off units. This arrangement is very advantageous in that the tension imparted to a core may be reduced to a value of not more than 50% of the breaking tension of the core, although the conventional techniques require to apply a tension of about 80–90% of the breaking tension.

The use of double capstans as the core feed unit is very advantageous in practice because a core is less contaminated at its surface when compared with the use of a pair of endless belts which clamp a core therebetween and carry it forward with the aid of friction. The double capstan system is preferable to a single capstan system because the latter system requires to wind a core around the capstan barrel several times. Such winding is unnecessary and a core is less damaged or contaminated in the former system. Contamination of a core at this stage not only renders the preceding cleaning step vain, but also adversely affects the adhesion of the core to a cladding metal.

Preheating of a core is achieved by conducting electric current thereinto according to a preferred aspect of this invention. Since the use of a number of pulleys for current conduction as such causes a core to oscillate and tension to vary, it is recommended to use a minimum number of pulleys for current conduction. It is therefore preferable to use a die box of the extruder as one of electrodes for conducting current into a core. It is also preferable to use a fixed or idler roll of the feed-rate correcting dancer roll assembly as another electrode for electrical conduction. The afore-mentioned concept of using the die box of the extruder as an electrode for electrical conduction is very convenient since the core is effectively and economically heated and electrical conduction is stable so that spark generation is substantially eliminated. This concept is also desirable from a point of view of preventing substantial oxidation due to heating.

The hard and soft metals which can be used herein are selected from the group consisting of steel, copper, aluminium, zinc, magnesium, lead, tin, cadmium and alloys thereof. It will be easy for one skilled in the art to select two materials among them and determine which one should be used as the hard or the soft metal by comparing the workability of the two. Among products fabricated by the present method most preferred is an aluminium clad steel wire.

BRIEF DESCRIPTION OF THE DRAWING

The above and other objects, features and advantages of the invention will be better understood from the following description taken in connection with the accompanying drawings in which.

DESCRIPTION OF THE PREFERRED EMBODIMENT

In the illustrated embodiment an aluminium clad steel wire is fabricated, although the invention can be applied to any composite metal wires.

Figure 1:
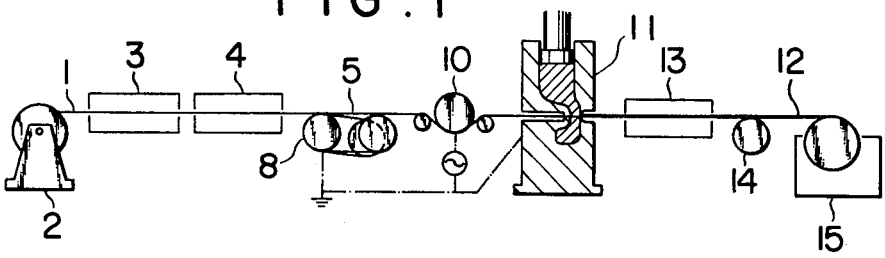
FIG. 1 is a schematic view of a system used for fabricating a composite metal wire according to this invention.
Figure 2:
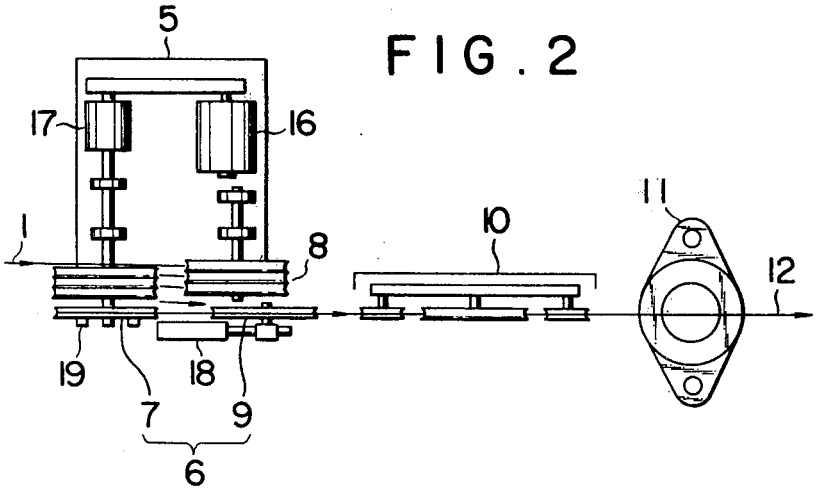
FIG. 2 is an enlarged view showing a dancer roll section in FIG. 1.

Referring to FIG. 1, a core of steel generally designated by numeral 1 and having a diameter of 5.5 mm is fed from a supply roll 2 to an extruder 11 through an aligning and polishing unit 3 which consists of an aligning equipment using rolls and an emery polishing equipment combined therewith, a cleaning unit 4 which contains an organic solvent for cleaning the core, and a core feed unit 5. As shown in FIG. 2, a dancer roll assembly 6 includes a fixed pulley 7 and a movable pulley 9 with their axes in a horizontal plane. The core feed unit 5 comprises double capstans 8, one of which is coaxially mounted with the fixed pulley 7. Each capstan has guide grooves recessed and a diameter of 1,000 mm in this embodiment. The core 1 is wound on the double capstans 8 alternately, then on the movable and fixed rolls 9 and 7 and thereafter routed toward the extruder 11. Numeral 10 designates one electrode for conducting electric current from a suitable source into the core to heat it. After the core 1 has passed the aluminium extruder 11, there is extruded an aluminium clad steel wire 12 having an outer diameter of 6.4 mm. The composite wire 12 passes a cooler 13 which has nozzles for spraying a coolant to cool the wire and then a haul-off unit 14 which has a drum for winding the wire thereon several times to haul it. The wire 12 is finally received by a winding machine 15.

The core feed and haul-off units 5 and 14 are forcedly driven by suitable means, respectively. Among such drive means, one for the core feed unit 5 is illustrated in FIG. 2. This drive means includes a feed-rate setting motor 16 adapted to operate synchronously with that for the haul-off unit 14 and a reduction gear 17. The feed-rate setting motor 16 may be a direct current motor having an output of 22 KW and a maximum revolution of 1,150 rpm.

For electrical heatig of the core 1, a die box of the extruder 11 and the fixed pulley 7 of the dancer roll assembly 6 are used as the other electrodes for conducting electric current into the core as diagramatically shown in FIG. 1. Accordingly, the core 1 is effectively heated between the fixed pulley 7 and the extruder 11. Numeral 19 designates a brush for elecrical conduction to the pulley 7.

In this embodiment, the core 1 is moved at a feed rate of 80 m/min. under a constant tension by means of the feed and haul-off units 5 and 14. With a current flow of 1,800 amperes, the core 1 is preheated to a temperature of 320° C. The temperature of the core heated reaches the highest level near the die box of the extruder 11 so that heating efficiency is very high.

The movable pulley 9 of the dancer roll assembly 6 is supported by an air cylinder 18 having an output of 300 Kg. Such a dancer roll arrangement ensures a feed-rate correcting capability of ±10% based on the set feed rate.

The core 1 is guided along the grooves of the double capstans 8 so that no sideslip will occur. When the core 1 passes the double capstans 8 interlocked with the haul-off 14, tension variation in the core 1 generated during the pretreatments is interrupted and the core 1 is thereafter kept under a constant low tension. The core 1 under a constant tension is introduced into the extruder 11 while it is heated. The tension to be imparted to the core 1 may preferably be 120–170 Kg though tensions ranging from 20 to 250 Kg have been found to be satisfactory. This tension range is far below tensions of more than 500 Kg required for the same core in the conventional techniques. Such a tension reduction is favorable in eliminating the danger of breakage. With no double capstans, only the haul-off 14 can hardly keep the core 1 under such stable conditions.

During extrusion an aluminium billet is generally heated to a temperature of 420° C. in order to improve the extrudability of aluminium and the adhesion of aluminium to steel or the core 1.

Since the core 1 is introduced into the extruder 11 under an ideal tension condition according to this invention, breaking, peeling, sparking and other problems are substantially eliminated, resulting in improved uniform products.

This invention can be applied to various composite wires. A considerable improvement is achieved over the prior art techniques since extrusion can be carried out under a low tension of not more than 50%, preferably 5–20% of the breaking tension of a core. According to this invention, a core is electrically heated in an advantageous manner to prevent tension variation and oscillation. This method also permits to reduce electrical power loss and to increase heating efficiency.

We claim:

1. Apparatus for fabricating a composite metal wire comprising an extruder for extruding a cladding of soft metal around a core of hard metal; a core feed unit located upstream of said extruder for feeding said core to said extruder; a haul-off unit located downstream of said extruder for receiving said composite wire from said extruder; drive means for forcedly driving said core feed unit and said haul-off unit so as to maintain said core under constant low tension of not more than 50% of the breaking tension of said core; and a dancer roll assembly located between said core feed unit and said haul-off unit, said dancer roll assembly comprising a fixed pulley and a movable pulley, said pulleys having their axes in a horizontal plane and said dancer roll assembly serving to compensate for error in the feed rate between said core feed unit and said haul-off unit, thereby substantially eliminating breaking, peeling, and sparking of said core.

2. The apparatus of claim 1, further comprising means for aligning and polishing said core and means for cleaning said core, said aligning and polishing means and said cleaning means being located upstream of said core feed unit.

3. The apparatus of claim 1, further comprising means for cooling said composite wire after exiting from said extruder.

4. The apparatus of claim 1, further comprising at least one pair of electrodes for conducting electric current into said core, thereby electrically preheating said core prior to extrusion.

5. The apparatus of claim 1, wherein said core feed unit comprises double capstans.

6. The apparatus of claim 1, wherein said drive means comprises a feed-rate setting motor operably connected to said core feed unit, and a second motor operably connected to said haul-off unit, said feed-rate setting motor being adapted to operate synchronously with said second motor.

7. The apparatus of claim 1, wherein said drive means maintains said core under a constant low tension of from about 5 to about 20% of the breaking tension of said core.

8. Apparatus for fabricating a composite metal wire comprising an extruder for extruding a cladding of soft metal around a core of hard metal; a core feed unit located upstream of said extruder for feeding said core to said extruder; a haul-off unit located downstream of said extruder for receiving said composite wire from said extruder; means for aligning and polishing said core and means for cleaning said core, said aligning and polishing means and said cleaning means being located upstream of said core feed unit; means for cooling said composite wire after exiting from said extruder; at least one pair of electrodes for conducting electric current into said core, thereby electrically heating said core; drive means for forcedly driving said core feed unit and said haul-off unit so as to maintain said core under a constant low tension of not more than 50% of the breaking tension of said core; and a dancer roll assembly located between said core feed unit and said haul-off unit, said dancer roll assembly comprising a fixed pulley and a movable pulley, said pulleys having their axes in a horizontal plane and said dancer roll assembly serving to compensate for error in the feed rate between said core feed unit and said haul-off unit, thereby substantially eliminating breaking, peeling, and sparking of said core.

9. The apparatus of claim 8, wherein a die box of said extruder and said fixed pulley of said dancer roll assembly are used as a pair of electrodes for conducting electric current into said core.

10. The apparatus of claim 8, wherein said core feed unit comprises double capstans, one of which is coaxially mounted with said fixed pulley.

11. The apparatus of claim 8, wherein said drive means comprises a feed-rate setting motor operably connected to said core feed unit and a second motor operably connected to said haul-off unit, said feed-rate setting motor being adapted to operate synchronously with said second motor.

12. The apparatus of claim 8, wherein said means for cooling comprises nozzles for spraying a coolant to cool said composite wire.

13. The apparatus of claim 8, wherein said drive means maintains said core under a constant low tension of from about 5 to about 20% of the breaking tension of said core.

14. Apparatus for fabricating a composite metal wire comprising an extruder for extruding a cladding of soft metal around a core of hard metal; a core feed unit comprising double capstans located upstream of said extruder for feeding said core to said extruder; a haul-off unit located downstream of said extruder for receiving said composite wire from said extruder; a dancer roll assembly located between said core feed unit and said haul-off unit, said dancer roll assembly serving to compensate for error in the feed rate between said core feed unit and said haul-off unit, thereby substantially eliminating breaking, peeling, and sparking of said core, said dancer roll assembly comprising a moveable pulley and a fixed pulley which is coaxially mounted with one of said double capstans of said core feed unit; means for aligning and polishing said core and means for cleaning said core, said aligning and polishing means and said cleaning means being located upstream of said core feed unit; nozzles for spraying a coolant to cool said composite wire after exiting from said extruder; at least one pair of electrodes for conducting electric current into said core, thereby heating said core, wherein a die box of said extruder and said fixed pulley of said dancer roll assembly are used as a pair of electrodes for conducting electric current into said core; and drive means for forcedly driving said core feed unit and said haul-off unit so as to maintain said core under a constant low tension of from about 5 to about 20% of the breaking tension of said core, said drive means comprising a feed-rate setting motor operably connected to said core feed unit and a second motor operably connected to said haul-off unit, said feed-rate setting motor being adapted to operate synchronously with said second motor.

* * * * *